US005254817A

United States Patent [19]

Inagaki

[11] Patent Number: 5,254,817

[45] Date of Patent: Oct. 19, 1993

[54] VACUUM SWITCH TUBE

[75] Inventor: Koichi Inagaki, Kagawa, Japan

[73] Assignee: Mitsubishi Denki Kabushiki Kaisha, Tokyo, Japan

[21] Appl. No.: 898,329

[22] Filed: Jun. 15, 1992

[30] Foreign Application Priority Data

Jun. 17, 1991 [JP] Japan ..... 3-171720

[51] Int. Cl.[5] ..... H01H 33/66; H01H 1/02

[52] U.S. Cl. ..... 200/144 B

[58] Field of Search ..... 200/144 A, 144 B, 262-270

[56] References Cited

U.S. PATENT DOCUMENTS

| | | | |
|---|---|---|---|
| 4,190,753 | 2/1980 | Gainer | 200/144 B |
| 4,419,551 | 12/1983 | Kato | 200/144 B |
| 4,695,687 | 9/1987 | Grosse et al. | 200/144 B |
| 4,749,830 | 6/1988 | Kippenberg et al. | 200/144 B |
| 4,806,714 | 2/1989 | Aoki | 200/144 B |
| 5,059,752 | 10/1991 | Inagaki | 200/144 B |
| 5,109,145 | 4/1992 | Fujita et al. | 200/144 B |

FOREIGN PATENT DOCUMENTS

| | | |
|---|---|---|
| 0119563 | 9/1984 | European Pat. Off. . |
| 0121180 | 10/1984 | European Pat. Off. . |
| 1805865 | 5/1970 | Fed. Rep. of Germany . |
| 2914186 | 10/1979 | Fed. Rep. of Germany . |
| 1224848 | 3/1971 | United Kingdom . |

OTHER PUBLICATIONS

*Patent Abstracts of Japan*, vol. 14, No. 383 (E-0966), Aug. 17, 1990.

*Patent Abstracts of Japan*, vol. 14, No. 229 (E-928) (4172), May 15, 1990.

*Primary Examiner*—J. R. Scott

*Attorney, Agent, or Firm*—Burns, Doane, Swecker & Mathis

[57] ABSTRACT

A vacuum switch tube comprises a stationary electrode and a movable electrode, each of which includes a main electrode and an auxiliary electrode. The main and auxiliary electrodes of each of the stationary and movable electrodes are formed of an alloy of a conductive metal and fire-resisting metal, with the ratio by volume of the conductive metal to the fire-resisting metal in the main electrode being lower than the ratio by volume of the conductive metal to the fire-resisting metal in the auxiliary electrode. These ratios cause the main electrodes to have a low welding power, with the result that, at the time of breaking a large current, an arc is rapidly moved. A small-size vacuum switch tube is thus provided in which the main electrodes require a small tripping force against welding therebetween and which is capable of breaking a large current and withstanding a high voltage.

7 Claims, 2 Drawing Sheets

VACUUM SWITCH TUBE

BACKGROUND OF THE INVENTION

1. Field of the Invention

This invention relates to an improvement in vacuum switch tubes used for switching a large electric current.

2. Description of the Prior Art

One example of a conventional vacuum switch tube is disclosed in Japanese Patent Application Laid-Open Specification No. 2-142024 (1990), corresponding to U.S. Pat. No. 5,059,752, and is constructed as shown in FIGS. 1 and 2. In the figures, reference numeral 1 denotes an insulating vacuum vessel evacuated to a high vacuum pressure of $10^{-4}$ Torr or below. A stationary electrode rod 4 is projecting downwardly from an upper stationary-side end plate 2 of the vacuum vessel 1. A movable electrode rod 5 is vertically movably disposed in the vessel 1 in opposed relation to the electrode rode 4 and is passed through a lower movable-side end plate 3 of the vessel 1. A bellows 6 is fitted over the movable electrode rod 5 and is secured at one end thereof to the electrode rod 5 and at the other end to the movable-side end plate 3.

The stationary electrode rod 4 is provided at its distal end with a stationary electrode 7, which includes a main electrode *7a* located at a central portion thereof, an auxiliary electrode *7b* located at the periphery of the central portion and connected to the electrode rod 4, and spiral grooves *7c* formed on the auxiliary electrode *7b*. The main electrode *7a* serves as a contact and current-passing portion when the vacuum switch tube is operated. Therefore, an electrode material containing a low melting point metal such as Bi or the like is used for the main electrode *7a* so that the electrode *7a* requires a small tripping force against welding thereof. On the other hand, a material capable of breaking a large current and having good withstand voltage performance is used for the auxiliary electrode *7b*.

The movable electrode rod 5 is provided at its distal end with a movable electrode 8, which is brought into contact with the stationary electrode 7 when the movable electrode rod 5 is moved upwardly. The movable electrode 8 comprises a main electrode *8a* located at a central portion thereof, an auxiliary electrode *8b* located at the periphery of the central portion and connected to the electrode rod 5, and spiral grooves *8c* formed on the auxiliary electrode *8b*. The main electrode *8a* serves as a contact and current-passing portion when the vacuum switch is operated. Therefore, an electrode material containing a low melting point metal such as Bi is used for the main electrode *8a* so that the electrode *8a* requires a small tripping force against welding thereof. On the other hand, a material capable of breaking a large current and having good withstand voltage performance is used for the auxiliary electrode *8b*.

Shield 9 is adapted to absorb a metal vapor emitted from the electrodes 7, 8 and is disposed on each side inside the vessel 1.

The operation of the vacuum switch tube will now be described. When the magnitude of the current flowing is of the order of a load or overload current, separation of the movable electrode 8 from the stationary electrode 7 completes the cut-off of the current in the regions of the main electrodes *7a*, *8a*.

When the current, however, is of a large magnitude, such as in a shortcircuit situation, separation of the stationary and movable electrodes 7 and 8 from each other causes an arc (not shown) to be generated between the main electrodes *7a* and *8a*. The arc generated becomes concentrated and is moved outwardly under the influence of a magnetic field developed by an external wiring or the like. Upon reaching the auxiliary electrodes *7b*, *8b*, the arc is given a rotating force by the spiral grooves *7c*, *8c* and is rotated around the center axis of the electrodes 7, 8 while moving further outwardly. This rotational motion of the arc prevents the same from stagnating locally to fuse and damage the electrodes 7, 8.

The prior art vacuum switch tube constructed as mentioned above shows insufficient withstand voltage performance, the main electrodes *7a*, *8a* of the stationary and movable electrodes 7, 8 containing a low melting point metal such as Bi or the like. Further, in the prior art vacuum switch tube, the generation of an arc between the main electrodes *7a* and *8a* is accompanied by a continuous emittance of a metal vapor from the low melting point metal in the main electrodes *7a*, *8a*, making it difficult for the arc to become concentrated. As a result, the arc tends to stagnate and fuse locally. Under such circumstances, a vacuum switch tube large in size has conventionally been used when breaking a large current.

SUMMARY OF THE INVENTION

This invention has focused attention on the above problems, and thus, it is an object of this invention to provide a vacuum switch tube which has an electrode structure ensuring less welding, stable break of large currents, and high withstand voltage performance and which is small in size.

To achieve the above object, a vacuum switch tube according to this invention comprises a vacuum vessel evacuated to a high vacuum pressure of $10^{-4}$ Torr or below, a stationary electrode rod disposed in the vacuum vessel and having a stationary electrode at the distal end thereof, said stationary electrode including a main electrode located at a central portion thereof and an auxiliary electrode located at the periphery of the central portion, and a movable electrode rod disposed in the vacuum vessel in oppposed relation to the stationary electrode rod and having a movable electrode at the distal end thereof, said movable electrode including a main electrode located at a central portion thereof and an auxiliary electrode located at the periphery of the central portion, said movable electrode being brought into and out of contact with the stationary electrode of the stationary electrode rod when the movable electrode rod is moved, wherein the main and auxiliary electrodes of each of the stationary and movable electrodes are formed of an alloy of an electrically-conductive metal and fire-resisting metal, with the ratio by volume of the conductive metal in the main electrode being lower than the ratio by volume of the conductive metal in the auxiliary electrode.

According to another aspect of this invention, the main and auxiliary electrodes of each of the stationary and movable electrodes are formed of an alloy of an electrically-conductive metal and fire-resisting metal, with the density ratio of the main electrode being lowered than the density ratio of the auxiliary electrode.

According to a further aspect of this invention, the main and auxiliary electrodes of each of the stationary and movable electrodes are formed of an alloy of an electrically conductive metal and fire-resisting metal, with the grain size of the main electrode being smaller than the grain size of the auxiliary electrode.

The main electrodes of the stationary and movable electrodes according to this invention have a low welding power and make it possible for an arc generated in breaking a large current to be rapidly moved from the main electrodes to the auxiliary electrodes.

DETAILED DESCRIPTION OF THE PREFERRED EMBODIMENTS

Figure 1:
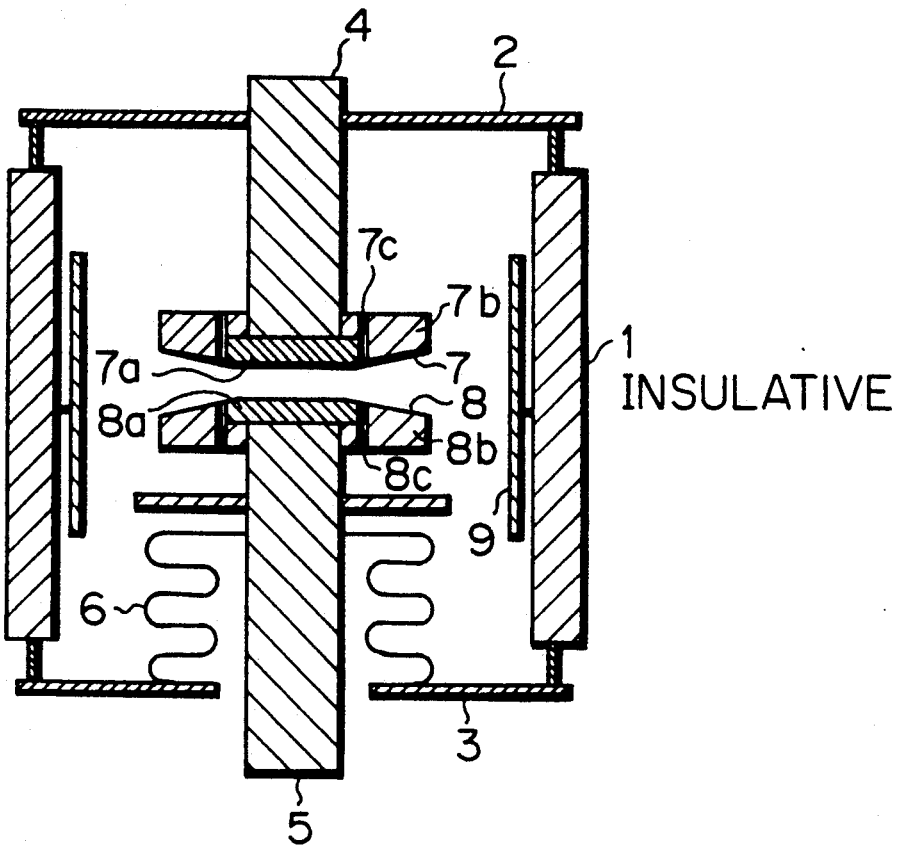
FIG. 1 is a sectional side view showing a vacuum switch tube according to this invention and a prior art vacuum switch tube.
Figure 2:
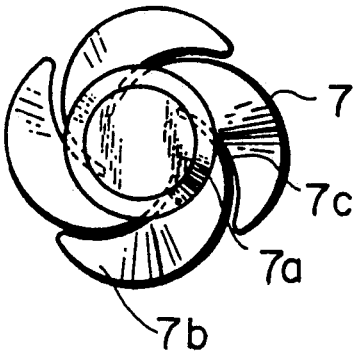
FIG. 2 is a sectional plan view showing a stationary electrode of a vacuum switch tube according to this invention and of a prior art vacuum switch tube.

A preferred embodiment of the present invention will hereinafter be described in detail with reference to FIGS. 1 and 2. In the figures, reference numeral 1 denotes an insulating vacuum vessel evacuated to a high vacuum pressure of $10^{-4}$ Torr or below. The vacuum vessel 1 includes an upward stationary-side end plate 2 and a lower movable-side end plate 3. A stationary electrode rod 4 is disposed in the vessel 1 with one end thereof being secured to the stationary-side end plate 2, and a vertically movable electrode 5 is disposed in the vessel 1 in opposed relation to the stationary electrode rod 4 and is passed through the movable-side end plate 3. A bellows 6 is fitted over the movable electrode rod 5 and is secured at one end thereof to the movable electrode rod 5 and at the other end to the movable-side end plate 3.

The stationary electrode rod 4 is provided at its distal end with a stationary electrode 7, which has a main electrode **7*a* located at a central portion thereof, an auxiliary electrode 7*b* located at the periphery of the central portion and connected to the stationary electrode rod 4, and spiral grooves 7*c* formed on the auxiliary electrode 7*b*. Unlike the prior art, the main electrode 7*a* is formed of an alloy of Cu - 55Cr and thus contains the conductive metal, Cu, in a small amount. Ratios of alloy components used herein are by volume. As a result, the main electrode 7*a* has a low ductility and requires a small tripping force against welding thereof, which welding is caused in breaking a large current. The auxiliary electrode 7*b*** is formed of an alloy of Cu - 30Cr.

The movable electrode rod 5 is provided at its distal end with a movable electrode 8, which is brought into and out of contact with the stationary electrode 7 located thereabove when the electrode rod 5 is moved. The movable electrode 8 has a main electrode **8*a* located at a central portion thereof, an auxiliary electrode 8*b* located at the periphery of the central portion and connected to the movable electrode rod 5, and spiral grooves 8*c* formed on the auxiliary electrode 8*b*. Unlike the prior art, the main electrode 8*a* is formed of an alloy of Cu - 55Cr and thus contains the electrically-conductive metal, Cu, in a small amount. As a result, the main electrode 8*a* has a low ductility and requires a small tripping force against welding thereof, which welding is caused in breaking a large current. The auxiliary electrode 8*b*** is formed of an alloy of Cu - 30Cr.

Denoted 9 is a shield adapted to absorb a metal vapor emitted from the electrodes 7, 8 and is disposed on each side inside the vessel 1.

With the construction as mentioned above, when a current is cut off whose magnitude is of the order of a load or overload current, separation of the main electrodes **7*a* and 8*a* from each other completes the break in the regions of the main electrodes 7*a*, 8*a***.

On the other hand, when a large current as in a short-circuit or the like is cut off, separation of the main electrodes **7*a* and 8*a* from each other causes an arc (not shown) to be generated therebetween, which arc is then moved outwardly under the influence of an external magnetic field. In this instance, since the main electrodes 7*a*, 8*a* do not contain a low melting point metal or the like, the arc generated becomes dense or concentrated and is rapidly moved from the main electrodes 7*a*, 8*a* to the auxiliary electrodes 7*b*, 8*b*. The force that drives the arc from the main electrodes 7*a*, 8*a* to the auxiliary electrodes 7*b*, 8*b* further drives the arc into a rotational motion around the center axis of the electrodes 7, 8, with the result that the arc is moved over the entire surfaces of the electrodes 7, 8**. Thus, local stagnation of the arc is prevented, which causes a rise in temperature and local fusing.

The above-mentioned electrode structure also has high withstand voltage performance, the main electrodes **7*a*, 8*a*** not containing a low melting point metal.

Figure 3:
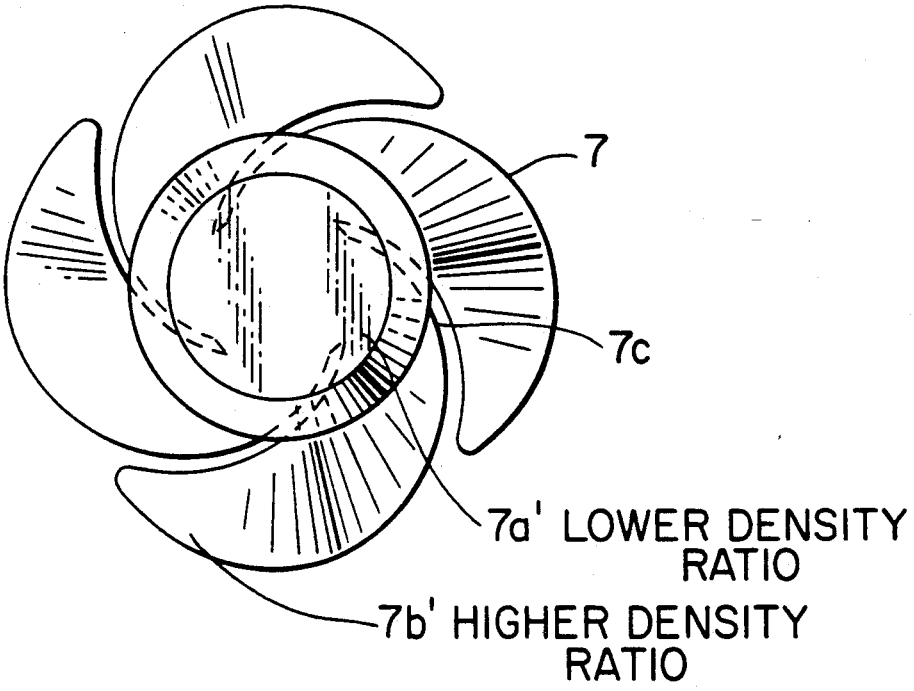
FIG. 3 shows the electrode made with low and high density ratio alloys in accordance with an embodiment of the present invention.

In the embodiment as mentioned above, an alloy of Cu - 55Cr is used for constituting the main electrodes **7*a*, 8*a* and an alloy of Cu - 30Cr for constituting the auxiliary electrodes 7*b*, 8*b*. The ratio of components, however, may be varied, and still the same effect as in the above embodiment may be obtained insofar as the ratio of the conductive metal in the main electrodes 7*a*, 8*a* is lower than that in the auxiliary electrodes 7*b*, 8*b*, and the ratio of the fire-resisting metal in the main electrodes 7*a*, 8*a* is higher to lower their ductility. Further, in order to obtain the same effect as in the above embodiment, conductive metals such as Ag, and Al may optionally be used in place of Cu, and fire-resisting metals such as Fe, Co, W, WC, Mo, and Nb may be used in place of Cr. The main electrodes 7*a*, 8*a* and auxiliary electrodes 7*b*, 8*b* may respectively be formed of different combinations of a conductive metal and fire-resisting metal. Referring now to FIG. 3, in another embodiment, the density ratio of the main electrodes 7*a*, may be made lower than the density ratio of the auxiliary electrodes 7*b*, to obtain the same effect as in the above embodiment. For example, the main electrodes 7*a*, 8*a* and auxiliary electrodes 7*b*, 8*b* are formed of an alloy of Cu - 30Cr to have density ratios of 80% and of 98%, respectively. An electrode having a density ratio of 85% may be easily made by, in the process of powder compression-molding, lowering the molding temperature and suppressing diffusion shrinkage of a conductive metal contained therein. The thus prepared low-density ratio electrode has a large number of pores therein and has a low welding power, thereby allowing, at the time of breaking a large current, an arc to become dense or concentrated and move rapidly from the main electrodes 7*a*, 8*a* to the auxiliary electrodes 7*b*, 8*b*. The auxiliary electrodes 7*b*, 8*b*** has a low density ratio and allows a large current to be cut off.

Figure 4:
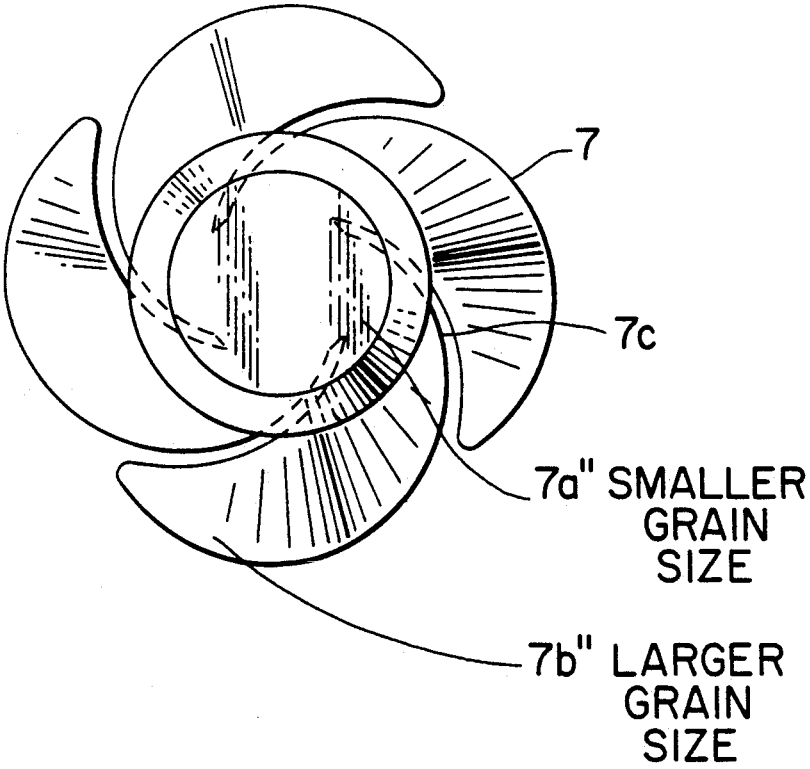
FIG. 4 shows the electrode made with low and high grain size alloys in accordance with an embodiment of the present invention.

Referring now to FIG. 4, in still another embodiment, the grain size of the main electrodes 7a'', may be made smaller than the grain size of the auxiliary electrodes 7b'' to provide a vacuum switch in which the main electrodes 7a'' require a low tripping force against welding therebetween and which is capable of breaking a large current and withstanding a high voltage.

As described hereinabove, according to this invention, an alloy of a conductive metal and fire-resisting metal is used for constituting the main and auxiliary electrodes of each of the stationary and movable electrodes, and the ratio by volume of the conductive metal in the main electrodes is lower than that in the auxiliary electrodes. Owing to the above, a small-size vacuum switch tube is provided whose electrodes require a small tripping force and which is capable of withstanding a high voltage and breaking a large current.

What is claimed is:

1. A vacuum switch tube comprising:

a vacuum vessel evacuated to a high vacuum pressure of $10^{-4}$ Torr or below;

a stationary electrode rod disposed in said vessel and having a stationary electrode at the distal end thereof, said stationary electrode including a main electrode located at a central portion thereof and an auxiliary electrode located at the periphery of the central portion; and a movable electrode rod disposed in said vessel in opposed relation to said stationary electrode rod and having a movable electrode at the distal end thereof, said movable electrode including a main electrode located at a central portion thereof and an auxiliary electrode located at the periphery of the central portion, said movable electrode being brought into and out of contact with said stationary electrode of the stationary electrode rod when said movable electrode rod is moved, wherein said main electrode of each of the stationary and movable electrodes is formed of a first alloy of an electrically-conductive metal and a fire-resisting metal, said auxiliary electrode of each of the stationary and movable electrodes are formed of a second alloy of the electrically-conductive metal and the fire-resisting metal, with the ratio by volume of the conductive metal to the fire-resisting metal in said first alloy being lower than the ratio by volume of the conductive metal to the fire-resisting metal in said auxiliary electrode.

2. A vacuum switch tube as claimed in claim 1, wherein said main and auxiliary electrodes of each of the stationary and movable electrodes are formed of an alloy of Cu and Cr, with the ratios by volume of Cu to Cr in said main and auxiliary electrodes being 45:55 and 70:30, respectively.

3. A vacuum switch tube comprising:

a vacuum vessel evacuated to a high vacuum pressure of $10^{-4}$ Torr or below;

a stationary electrode rod disposed in said vessel and having a stationary electrode at the distal end thereof, said stationary electrode including a main electrode located at a central portion thereof and an auxiliary electrode located at the periphery of the central portion; and a movable electrode rod disposed in said vessel in opposed relation to said stationary electrode rod and having a movable electrode at the distal end thereof, said movable electrode including a main electrode located at a central portion thereof and an auxiliary electrode located at the periphery of the central portion, said movable electrode being brought into and out of contact with said stationary electrode of the stationary electrode rood when said movable electrode rod is moved, wherein said main electrode of each of the stationary and movable electrode is formed of a first alloy of an electrically-conductive metal and a fire-resisting metal, said auxiliary electrode of each of the stationary and movable electrode is formed of a second alloy of the electrically-conductive metal and the fire-resisting metal, with the density ratio of said first alloy being lower than the density ratio of said second alloy.

4. A vacuum switch tube comprising:

a vacuum vessel evacuated to a high vacuum pressure of $10^{-4}$ Torr or below;

a stationary electrode rod disposed in said vessel ad having a stationary electrode at the distal end thereof, said stationary electrode including a main electrode located at a central portion thereof and an auxiliary electrode located at the periphery of the central portion; and a movable electrode rod disposed in said vessel in opposed relation to said stationary electrode rod and having a movable electrode at the distal end thereof, said movable electrode including a main electrode located at a central portion thereof and an auxiliary electrode located at the periphery of the central portion, said movable electrode being brought into and out of contact with said stationary electrode of the stationary electrode rod when said movable electrode rod is moved, wherein said main electrode of each of the stationary and movable electrodes is formed of a first alloy of an electrically-conductive metal and a fire-resisting metal, said auxiliary electrode of each of the stationary and movable electrodes is formed of a second alloy of the electrically-conductive metal and the fire-resisting metal, with the grain size of said first alloy being smaller than the grain size of said second alloy.

5. A vacuum switch tube as claimed in claim 1, wherein the electrically-conductive metal for constituting said main and auxiliary electrodes is selected from the group consisting of Cu, Ag and Al, and the fire-resisting metal is selected from the group consisting of Cr, Fe, Co, W, WC, Mo and Nb.

6. A vacuum switch tube as claimed in claim 3, wherein the electrically-conductive metal for constituting said main and auxiliary electrodes is selected from the group consisting of Cu, Ag and Al, and the fire-resisting metal is selected from the group consisting of Cr, Fe, Co, W, SC, Mo and Nb.

7. A vacuum switch tube as claimed in claim 4, wherein the electrically-conductive metal for constituting said main and auxiliary electrodes is selected from the group consisting of Cu, Ag and Al, and the fire-resisting metal is selected from the group consisting of Cr, Fe, Co, W, WC, Mo and Nb.

* * * * *

UNITED STATES PATENT AND TRADEMARK OFFICE

CERTIFICATE OF CORRECTION

PATENT NO. : 5,254,817

DATED : October 19, 1993

INVENTOR(S) : Koichi INAGAKI

It is certified that error appears in the above-indentified patent and that said Letters Patent is hereby corrected as shown below:

In Column 6, line 58, delete "SC" and insert -- WC --.

Signed and Sealed this

Third Day of May, 1994

Bruce Lehman

*Attest:*

BRUCE LEHMAN

*Attesting Officer*

*Commissioner of Patents and Trademarks*